US010357077B2

(12) United States Patent
Pietrzak

(10) Patent No.: US 10,357,077 B2
(45) **Date of Patent: *Jul. 23, 2019**

(54) PROTECTIVE BICYCLE HELMET WITH INTERNAL VENTILATION SYSTEM

(71) Applicant: Bell Sports, Inc., Scotts Valley, CA (US)

(72) Inventor: Christopher T. Pietrzak, Ben Lomond, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 315 days.

This patent is subject to a terminal disclaimer.

(21) Appl. No.: 15/238,507

(22) Filed: Aug. 16, 2016

(65) Prior Publication Data

US 2017/0006954 A1 Jan. 12, 2017

Related U.S. Application Data

(63) Continuation of application No. 13/838,138, filed on Mar. 15, 2013, now Pat. No. 9,414,636.

(60) Provisional application No. 61/621,237, filed on Apr. 6, 2012.

(51) Int. Cl.

| | |
|---|---|
| ***A42B 3/28*** | (2006.01) |
| ***A42B 3/06*** | (2006.01) |
| ***A42B 3/12*** | (2006.01) |
| ***A42B 3/08*** | (2006.01) |

(52) U.S. Cl.

CPC ..... *A42B 3/283* (2013.01); *A42B 3/066* (2013.01); *A42B 3/085* (2013.01); *A42B 3/12* (2013.01); *A42B 3/28* (2013.01); *A42B 3/281* (2013.01)

(58) Field of Classification Search

USPC ..... 2/411, 417

See application file for complete search history.

(56) References Cited

U.S. PATENT DOCUMENTS

| | | | |
|---|---|---|---|
| 4,434,514 | A | 3/1984 | Sundahl et al. |
| 5,551,094 | A | 9/1996 | Navone |
| 6,389,607 | B1 | 5/2002 | Wood |
| 7,222,374 | B2 | 5/2007 | Musal et al. |
| 2010/0005573 | A1 | 1/2010 | Rudd |

FOREIGN PATENT DOCUMENTS

| | | |
|---|---|---|
| WO | 2011139224 | 11/2011 |

*Primary Examiner* — Katherine M Moran

(74) *Attorney, Agent, or Firm* — Booth Udall Fuller, PLC

(57) ABSTRACT

A bicycle helmet for protecting the head of a wearer includes an outer shell and an energy dissipating inner layer coupled to the outer shell. The inner layer defines an inner surface, and front attachment locations are inwardly offset from the inner surface substantially at a frontal portion of the helmet. Rear attachment locations are inwardly offset from the inner surface substantially at a rear portion of the helmet. An internal ventilation system is supported by the front attachment locations and the rear attachment locations. The internal ventilation system is configured for direct engagement with the head of the wearer for supporting the helmet upon the head of the wearer. The internal ventilation system provides a gap between the head of the wearer and the inner surface. The gap allows ventilating air to flow over a substantial extent of the wearer's head and within the helmet.

20 Claims, 17 Drawing Sheets

PROTECTIVE BICYCLE HELMET WITH INTERNAL VENTILATION SYSTEM

CROSS REFERENCE TO RELATED APPLICATION(S)

This application is a continuation to earlier U.S. application Ser. No. 13/838,138, filed Mar. 15, 2013, now pending, which application claims the benefit of and priority to U.S. Provisional Patent Application No. 61/621,237, filed Apr. 6, 2012, the entire contents of which are hereby incorporated by reference herein.

TECHNICAL FIELD

The invention generally relates to a protective bicycle helmet, more particularly to a protective bicycle helmet having a unique internal ventilation system that reduces heat build-up and retention, and that can provide an adjustable fit for the helmet wearer.

BACKGROUND OF THE INVENTION

A physical impact to the head of a person may cause serious injury or death. To reduce the probability of such consequences, protective gear, such as a helmet, is often used in activities that are associated with an increased level of risk for a head injury. Examples of such activities include, but are not limited to, skiing, snowboarding, bicycling, rollerblading, rock climbing, skate boarding, and motorcycling. In general, a helmet is designed to maintain its structural integrity and stay secured to the head of a wearer during an impact.

Accordingly, a bicycle helmet is designed to protect the cyclist's (or wearer's) head, including to absorb and dissipate energy during an impact with a surface, such as the ground. In this regard, most bicycle helmets are designed only to withstand a single major impact, and to thereafter be replaced with a new helmet. Bicycle helmet interiors include impact attenuating materials such as an arrangement of padding and/or foam, wherein the impact attenuating materials cover and contact a significant extent of the wearer's head. In this manner, the impact attenuating materials directly or intimately contact the wearer's head, however, this arrangement can result in undesirable heat build-up and/or retention when the helmet is worn during the sporting activity. The heat build-up and/or heat retention is exacerbated in a variety of conditions, such as when the cyclist is participating in a race or training session in a warm environment.

Some bicycle helmets seek to reduce heat retention by providing openings and channels in the helmet shell and the impact attenuating materials. The openings and channels are configured to promote air movement over portions of the wearer's head. For example, a conventional helmet sold by Specialized Bicycle Components, Inc. includes a front inlet formed in the helmet shell and configured to provide for flow of inlet air onto and over the wearer's forehead. Channels are provided over and around a crown area of the head, and a rear port communicating with the channels discharges air flow supplied by the front inlet through the channels while the wearer moves in a forward direction relative to the ground. However, the impact attenuating material of this conventional helmet directly contacts the wearer's head.

The conventional helmet suffers from a number of limitations including reduced structural integrity of the helmet shell due to the front inlet and the rear port. The reduced structural integrity also impacts the helmet's protection factor. Also, ventilating the helmet by providing a collection of openings and channels in the helmet shell increases aerodynamic drag of the helmet while the wearer moves in a forward direction, such as during a race or training session. What is needed is a protective bicycle helmet that does not rely exclusively upon a collection of openings, including inlets and ports, formed in the helmet shell to provide ventilation and facilitate air movement over a wearer's head within the helmet.

The present invention is provided to solve these limitations and to provide advantages and aspects not provided by conventional bicycle helmets. A full discussion of the features and advantages of the present invention is deferred to the following detailed description, which proceeds with reference to the accompanying drawings.

SUMMARY OF THE INVENTION

The present invention is directed to a protective helmet that includes a number of improvements intended to increase the ventilating attributes of the helmet, including an internal ventilation system configured to contact the wearer's head. Therefore, in some aspects, a bicycle helmet for protecting the head of a wearer includes an outer shell and an energy dissipating inner layer coupled to the outer shell. The inner layer defines an inner surface, and a front attachment location is inwardly offset from the inner surface substantially at a frontal portion of the helmet. A rear attachment location is inwardly offset from the inner surface substantially at a rear portion of the helmet. The internal ventilation structure is configured for direct engagement with the head of the wearer for supporting the helmet upon the head of the wearer. The internal ventilation system, the front attachment location, and the rear attachment location cooperate to define a functional gap between the head of the wearer and the inner surface.

While it is desirable that a protective bicycle helmet prevents injuries from occurring, it should be noted that due to the nature of recreational or competitive bicycling, no helmet, including the helmet of the present invention, can completely prevent injuries to bicyclists. It should be further noted that no protective equipment can completely prevent injuries to a cyclist, particularly when such equipment is improperly used, or when the cyclist disobeys the rules of the road or engages in other reckless or dangerous conduct. When properly worn, the helmet of the present invention is believed to offer protection to cyclists, but it is believed that no helmet can, or will ever, totally and completely prevent injuries to bicyclists.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings.

Figure 1A:
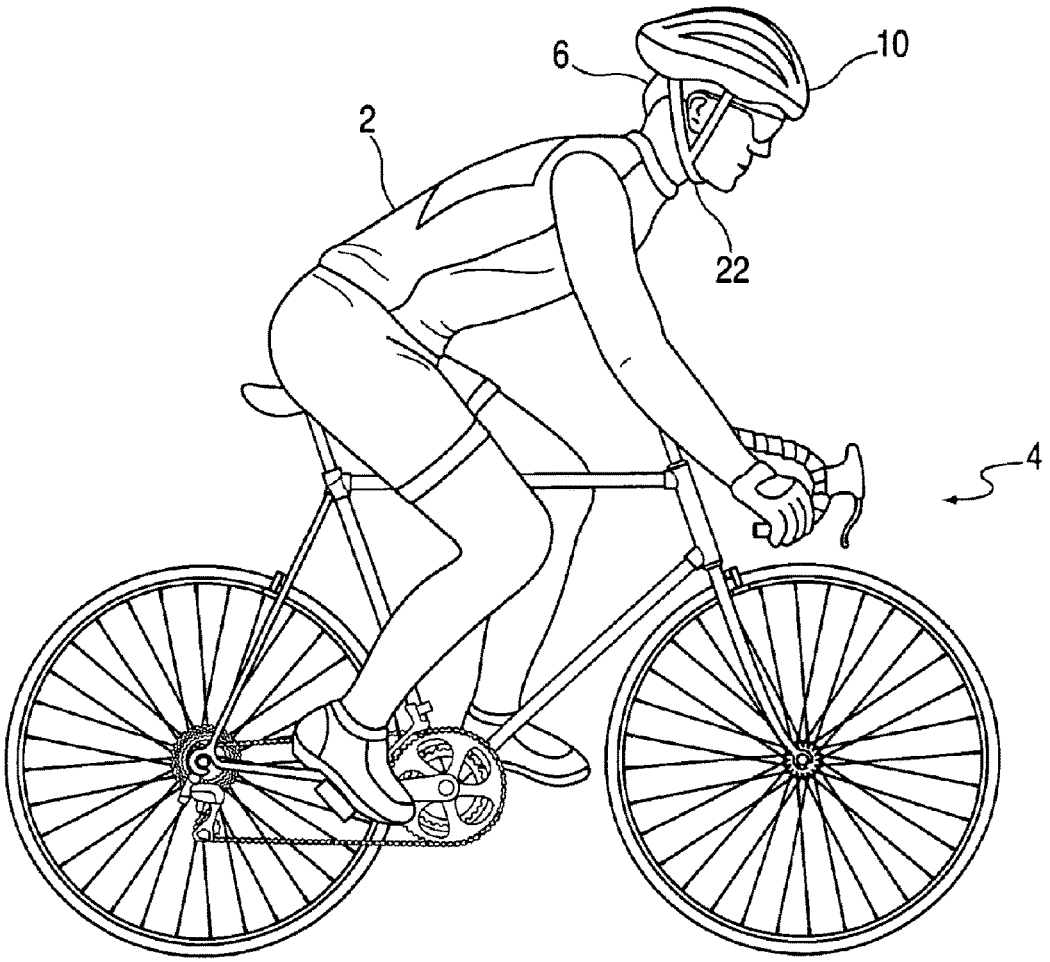
FIG. 1*a* illustrates a bicyclist wearing a bicycle helmet.

While the invention will be described in connection with the preferred embodiments shown herein, it will be understood that it is not intended to limit the invention to those embodiments. On the contrary, it is intended to cover all alternatives, modifications, and equivalents, as may be included within the spirit and scope of the invention as defined by the appended claims.

DETAILED DESCRIPTION

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

In the Figures, and referring initially to FIG. 1*a*, a cyclist (or wearer) 2 is shown riding a bicycle 4 and wearing the inventive bicycle helmet 10. The helmet 10 is secured to the head 6 of the wearer or cyclist by a chinstrap assembly 22. As discussed further below, when the cyclist 2 pedals the bicycle 4 and travels in a forward direction, air flows through the helmet 10 and over the wearer's head 6, thereby cooling the wearer's head 6.

Figure 1B:
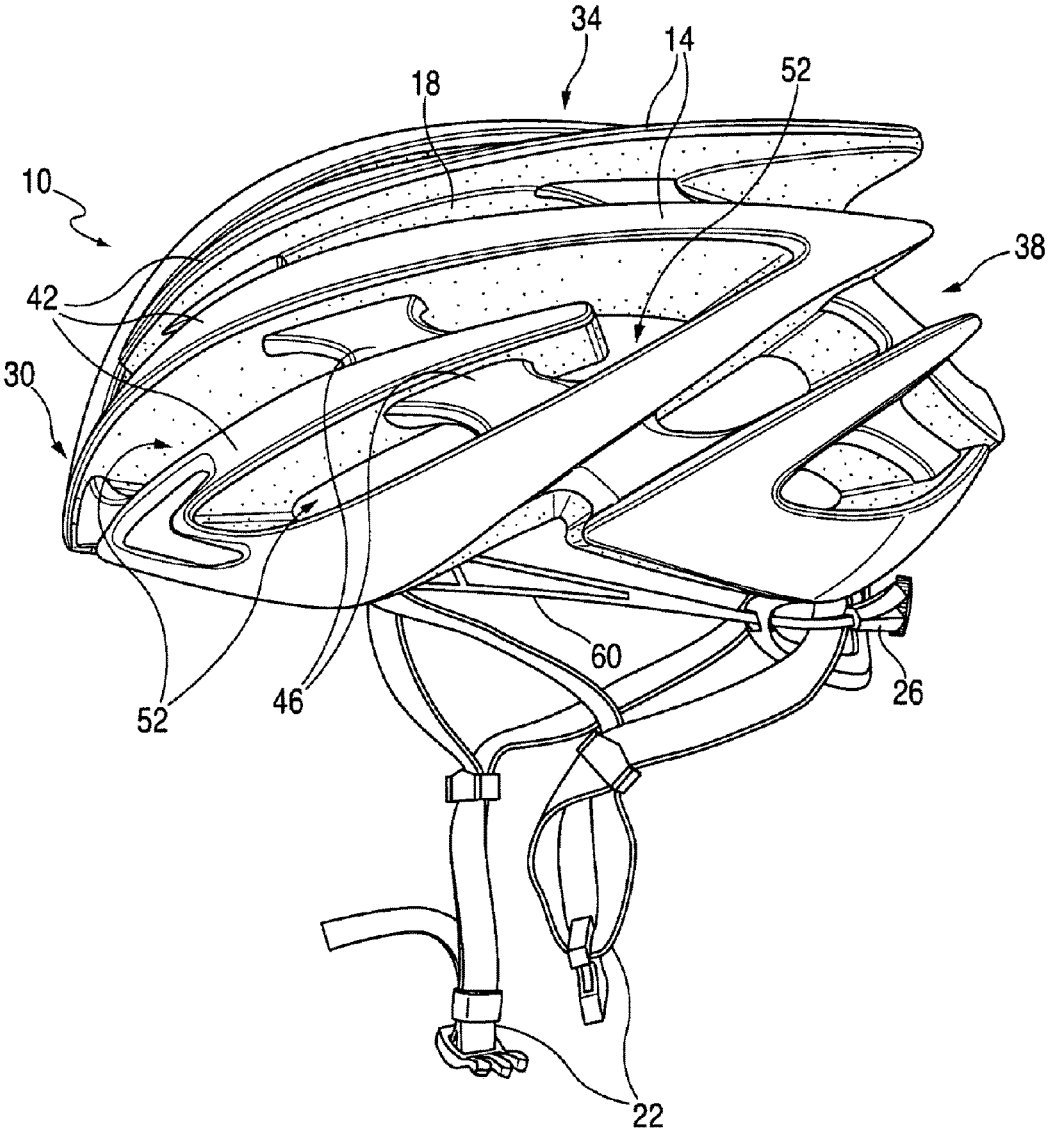
FIG. 1*b* is a left side view of an embodiment of an inventive bicycle helmet with an internal ventilation system.
Figure 2:
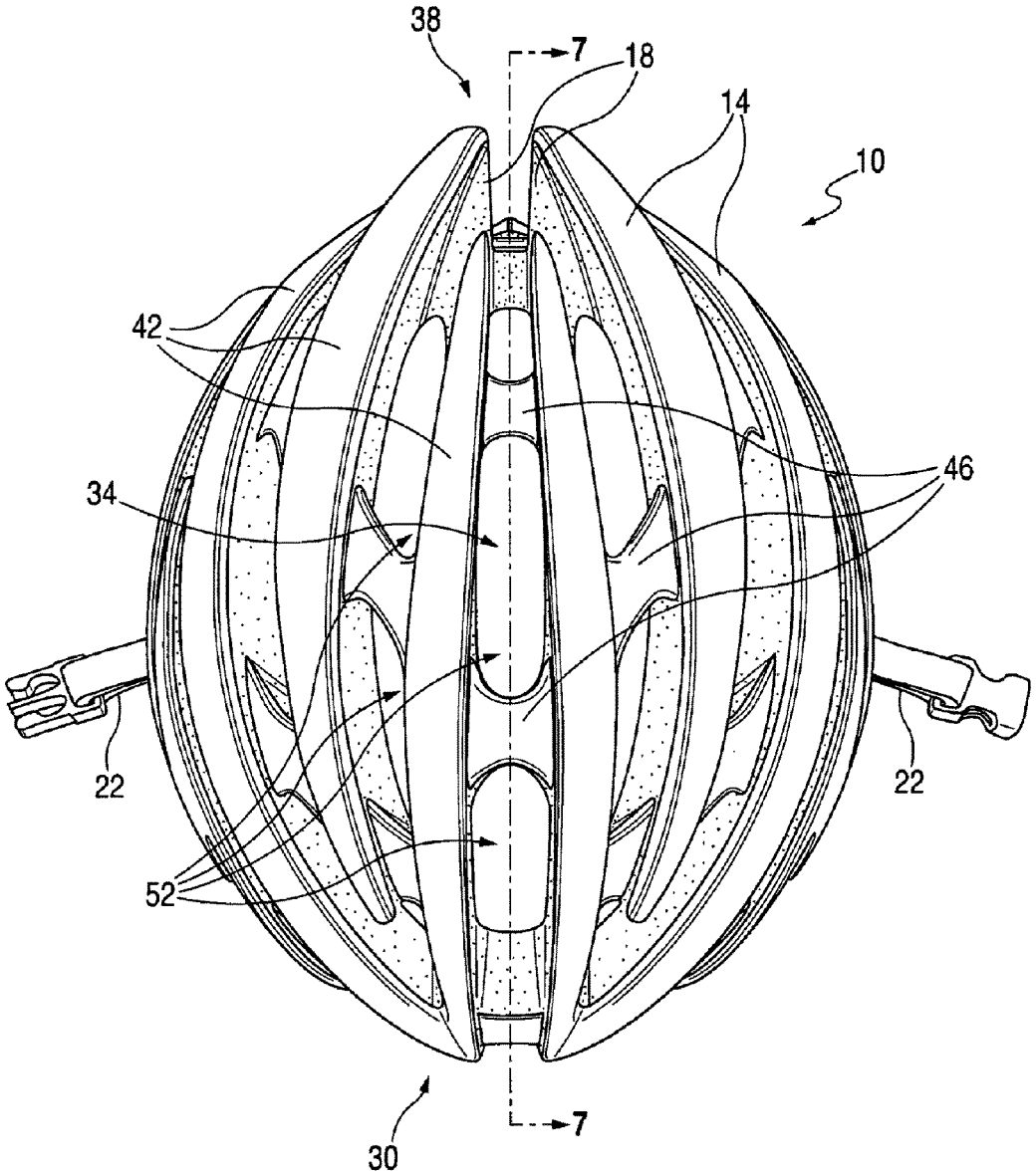
FIG. 2 is a top view of the helmet of FIG. 1*b*.
Figure 3:
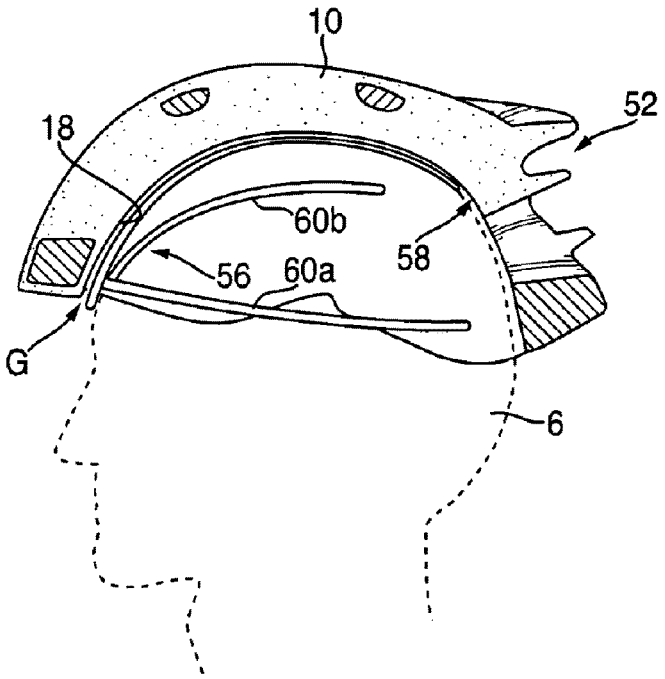
FIG. 3 is schematic side view showing the helmet of FIG. 1*b* in partial section and secured to the head of a wearer.
Figure 4:
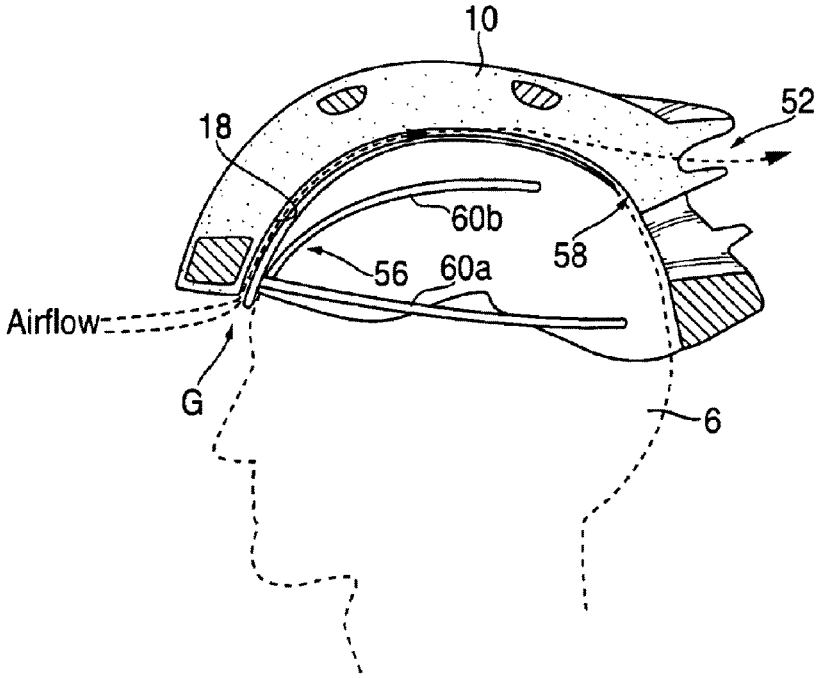
FIG. 4 is a schematic side view similar to FIG. 3 showing airflow through the helmet.
Figure 5:
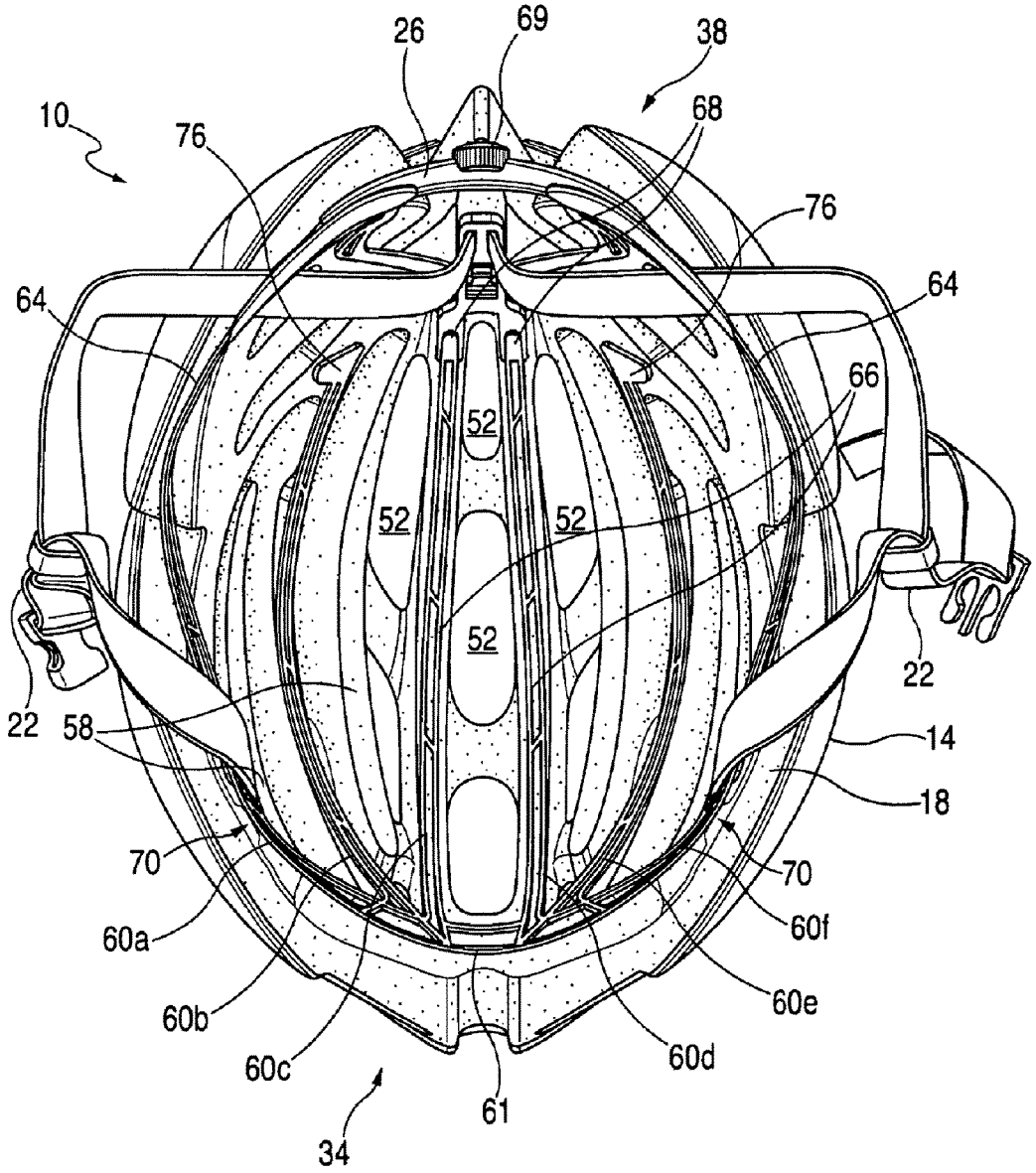
FIG. 5 is a bottom view of the helmet of FIG. 1*b* showing an internal ventilation system.

Referring also to FIGS. 1*b* and 2, an embodiment of the helmet 10 in accordance with the present invention is shown and includes a relatively hard, impact-resistant outer shell 14, at least one energy dissipating inner layer 18, the chinstrap assembly 22 for securing the helmet 10 to the wearer's head 6, and an adjustment mechanism 26 for adjusting the fit of the helmet 10 on the wearer's head 6. In some embodiments the outer shell 14 comprises a hard plastic material, such as polycarbonate; however, in other embodiments, the outer shell 14 may also or alternatively comprise KEVLAR, ABS plastic, carbon fiber, fiberglass, and the like. In some embodiments, the inner layer 18 comprises expanded polystyrene ("EPS"); however, in other embodiments, the inner layer 18 may also or alternatively comprise expanded polypropylene ("EPP") or other energy management or energy absorbing materials. The chinstrap assembly 22 includes connectable segments attached to one or both of the outer shell 14 and the inner layer 18 for securing the helmet 10 to the wearer's head 6, as generally known in the art. The helmet 10 includes a frontal portion 30 that overlies the wearer's forehead, a top or crown portion 34 that overlies the crown region of the wearer's head 6, and a rear portion 38 that overlies at least the wearer's occipital region.

In the illustrated embodiment, the helmet 10 includes a plurality of ribs 42 extending longitudinally substantially between the frontal and rear portions 30, 38 and connected by generally laterally extending webs 46. The ribs 42 and webs 46 cooperate to define ventilation openings 52 that extend through the helmet 10 from the helmet exterior to the helmet interior. The helmet 10 of FIGS. 1*a*-13 is what is known in the cycling field as a "road" helmet and is designed for general use during recreational and certain types of competitive cycling. It should be appreciated that the inventive concepts and teachings discussed herein are equally applicable to other types of bicycle helmets, such as a "sprinter" helmet, as shown in FIG. 14, and an "aero" helmet. As shown in FIG. 14 and as understood by those in the art, a sprinter helmet is designed to be more aerodynamic than the illustrated road helmet 10, and as such has a more smoothly contoured outer shell 14 and fewer ventilation openings 52. As also understood by those in the art, an aero helmet is designed to be even more aerodynamic, having a substantially streamlined shape that resembles a "tear-drop" configuration. Aero helmets are also configured to have as few ventilation openings 52 as possible, and in many cases have no ventilation openings whatsoever. As those skilled in the art will come to appreciate, the benefits and advantages associated with the inventive concepts and teachings discussed herein may become more apparent to the wearer as the number of ventilation openings 52 in the helmet 10 decrease.

Referring also to FIGS. 3-7, the helmet 10 includes an internal ventilation system 56 that adjustably contacts the wearer's head 6 to support the helmet 10 while defining a ventilation gap G or offset between the wearer's head 6 and an inner surface 58 of the inner helmet layer 18. This ventilation gap G extends across the outer surface of the wearer's head 6 from the wearer's forehead region over the crown region and to the occipital region. Because the inner surface 58 of the inner layer 18 is spaced apart from the wearer's head 6, ventilating air can flow through the gap G and between the wearer's head 6 and the inner surface 58. This ventilation gap G is provided in helmets having several ventilation openings 52, such as the illustrated helmet 10, and also is provided in helmets having few or no ventilation openings, such as the sprinter and aero helmets discussed above.

Figure 8:
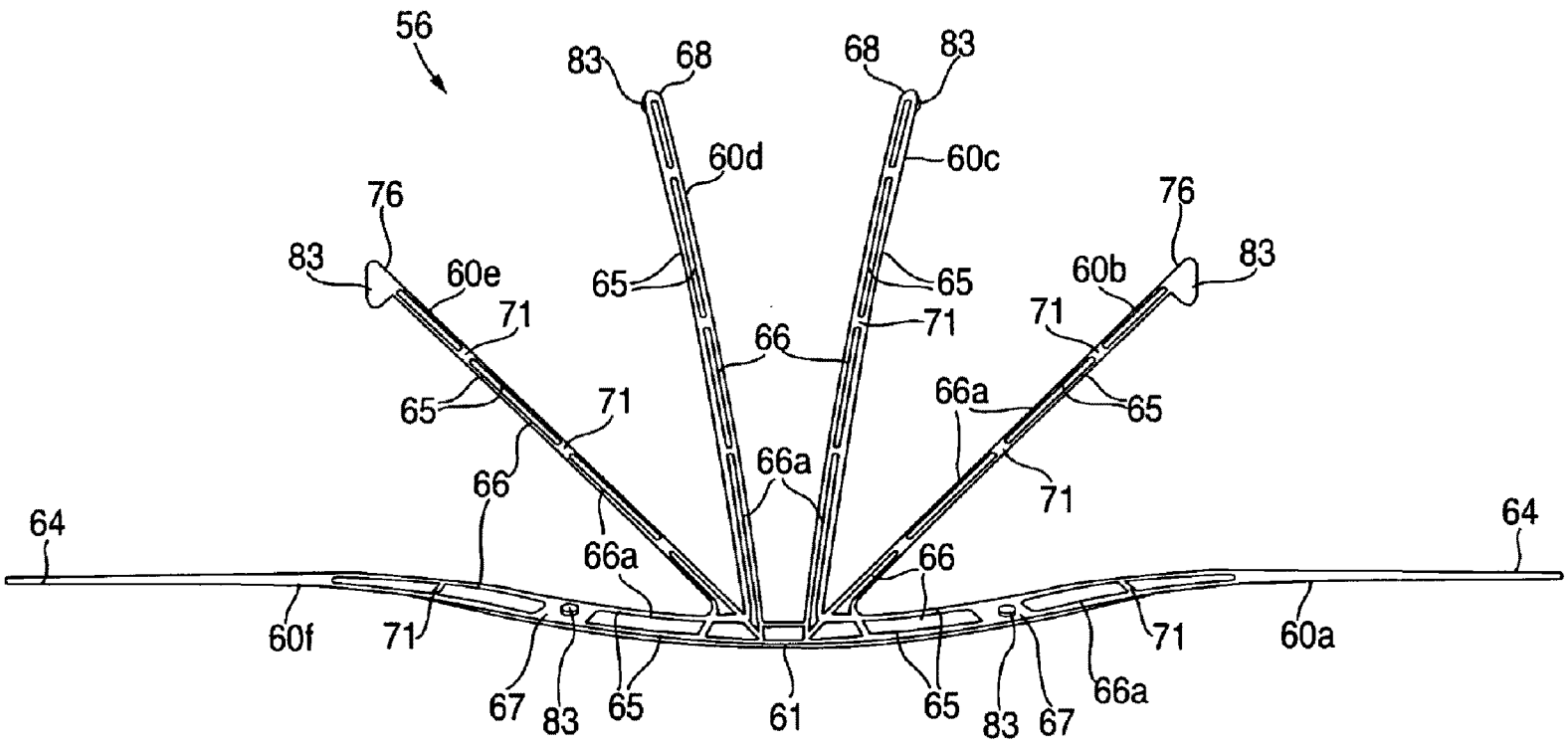
FIG. 8 is a plan view showing the internal ventilation system for the helmet of FIG. 1*b* in an uninstalled configuration.

Referring also to FIG. 8, the illustrated embodiment of the internal ventilation system 56 is in the form of a web-like structure that includes a plurality of generally longitudinally extending fingers 60 *a*, 60 *b*, 60 *c*, 60 *d*, 60 *e*, and 60 *f* (referred to collectively hereinafter as fingers 60). The fingers 60 generally converge with one another at a front portion 61 of the internal ventilation system 56, which is located substantially at the frontal portion 30 of the helmet 10 when the internal ventilation system 56 is installed in the helmet 10. As shown in FIG. 8, when not installed in the helmet 10 the internal ventilation system 56 is substantially flat and the fingers 60 extend away from the front portion 61. The internal ventilation system 56 is flexible such that, when installed in the helmet 10, the fingers 60 are curved and generally follow the curvature of the inner layer 18.

Each of the fingers 60 has a pair of rails 65 intermittently joined by transverse ribs 71. The rails 65 and the ribs 71 cooperate to define a plurality of finger ventilation apertures 66 in the form of generally elongated slots 66 *a*. The finger ventilation apertures 66 can further improve the ventilating characteristics of the internal ventilation system 56 by minimizing the total surface area of the internal ventilation system 56 that is in intimate contact with the wearer's head 6. Alternatively the fingers 60 are configured with a single rail 65 that precludes the apertures 66. Some embodiments of the internal ventilation system 56 are formed of a substantially rigid but flexible material, such as rubber, plastic, carbon fiber, and the like. The fingers 60 may also include an additional material, such as a coating, to facilitate engagement with the wearer's head 6.

The fingers 60 of the illustrated embodiment are arranged substantially in pairs. A first pair of the fingers 60 includes the outer fingers 60 *a* and 60 *f* that extend generally from the helmet frontal portion 30 toward the helmet rear portion 38 by extending laterally around the side portions of the helmet 10. The outer fingers 60 *a*, 60 *f* include pad portions 67 that, in the illustrated embodiment, are located approximately one-quarter to one-third of the way rearward along the length of the outer fingers 60 *a*, 60 *f*. The pad portions 67 lack ventilation apertures 66 and are provided for securing the outer fingers 60 *a*, 60 *f* to the helmet 10. More specifically, the pad portions 67 are attached to a pair of front attachment locations 70 that offset the outer fingers 60 *a*, 60 *f* from the inner surface 58 of the helmet 10, as discussed further below. Distal ends 64 of the outer fingers 60 *a*, 60 *f* extend into the adjustment mechanism 26 located substantially adjacent the rear portion 38 of the helmet 10.

When the helmet 10 is properly worn, the outer fingers 60 *a*, 60 *f* extend laterally from the wearer's forehead, around the sides of the wearer's head 6, passing approximately over the wearer's temples, and into the adjustment mechanism 26. In some embodiments, including the illustrated embodiment, the adjustment mechanism 26 is configured for direct engagement with the wearer's head 6 and includes an actuator 69 (such as a dial, knob, or other adjustor that reels in or pays out the distal ends 64 of the outer fingers 60 *a*, 60 *f*) to adjust the fit of the internal ventilation system 56. For example, by reeling in the distal ends 64 of the outer fingers 60 *a*, 60 *f*, the internal ventilation system 56 is tightened against the wearer's head 6, whereas by paying out the distal ends 64 of the outer fingers 60 *a*, 60 *f*, the internal ventilation system 56 is loosened from the wearer's head 6. In this regard, the outer fingers 60 *a*, 60 *f* are adjustable to account for the size of the wearer's head 6.

It should be understood that use and incorporation of the adjustment mechanism 26 with the internal ventilation system 56 is not required. For example, in some embodiments, the internal ventilation system 56 may be of a substantially fixed size and configuration, wherein such variations in the size or shape of a wearer's head may be accommodated by the flexibility of the materials of the system 56. Some embodiments may also or alternatively include fit adjusting components or structure distinct from the internal ventilation system 56. For example, in one exemplary embodiment the outer fingers 60 *a*, 60 *f* terminate near the front attachment locations 70, and a separate strap, band, or similar structure may be provided that extends generally around the rear occipital region of the wearer's head 6. The strap, band, or similar structure may formed of a resilient material, such as elastic, and may therefore be inherently adjustable, or the strap, band or similar structure may be operably connected to an adjustment mechanism similar to the adjustment mechanism 26 discussed above.

Referring again to the embodiment illustrated in FIGS. 3-8, a second pair of the fingers 60 includes the innermost fingers 60 *c* and 60 *d* that extend generally rearward along the inner helmet surface 58 from the frontal portion 30, along the crown portion 34, and toward the rear portion 38 of the helmet 10. Distal ends 68 of the innermost fingers 60 *a*, 60 *f* are attached to the interior of the helmet 10 at first rear attachment locations 72 (FIG. 7), which are raised relative to the inner helmet surface 58 of the helmet 10, as discussed further below. When the helmet 10 is properly worn, the innermost fingers 60 *c*, 60 *d* extend generally from the wearer's forehead and over the crown of the wearer's head 6.

A third pair of the fingers 60 includes the intermediate fingers 60 *b* and 60 *e* that extend generally upwardly and outwardly along the inner helmet surface 58 from the frontal portion 30, around and over the wearer's head 6, and inwardly and downwardly toward the rear portion 38. Distal ends 76 of the intermediate fingers 60 *b*, 60 *e* are attached to the interior of the helmet 10 at second rear attachment locations 80 (FIG. 7), which are raised relative to the inner surface 58 of the helmet 10, as discussed further below. When viewed from the front of the helmet 10, the intermediate fingers 60 *b*, 60 *e* are oriented at approximately 90 degrees with respect to one another, and extend over the wearer's head 6 at a location substantially mid-way between the outer fingers 60 *a*, 60 *f* and the innermost fingers 60 *c*, 60 *d*.

Although the illustrated helmet 10 includes six fingers 60, it should be appreciated that more or fewer fingers, and fingers having different shapes, sizes, configurations, and orientations may be utilized. For example, a heavier helmet may require additional support and, as such, additional or larger fingers, and additional attachment points may be incorporated into the internal ventilation system 56 and into the inner layer 18. In another exemplary embodiment, rather than two innermost fingers 60 *c*, 60 *d*, a single center finger extending substantially down the middle of the helmet 10 may be provided. In still other embodiments, the innermost fingers 60 *c*, 60 *d* may be removed entirely, leaving the two intermediate fingers 60 *b*, 60 *e*. In still other embodiments, rather than including fingers 60 that extend generally from front to back, the internal ventilation system 56 may include fingers 60 that extend transversely from side to side and/or generally diagonally through the helmet 10. In such alternative embodiments, the specific position of the attachment locations may be changed to account for the different orientation of the fingers 60.

Other embodiments of the internal ventilation system 56 may also or alternatively include one or more annular structures coupled to the inner layer 18 at suitably positioned attachment locations. Such annular structures may be complete circles or partial circles configured to directly engage crown portions of the wearer's head 6. The annular structures may be arranged generally in a concentric fashion, with the smallest annular structure positioned nearest a top of the wearer's head 6, and with larger annular structures being positioned lower on the wearer's head 6. The concentric structures may be joined to one another by generally radially extending web sections, or may be individually coupled to attachment locations provided on the inner layer 18 and offset from the inner helmet surface 58. Some embodiments may also include a combination of one or more annular structures and one or more fingers 60. The one or more annular structures can be combined with fingers 60 extending generally front to back, side to side, diagonally, or any combination thereof.

In the illustrated embodiment of FIG. 8, each of the pad portions 67 and the distal ends 68, 76 of the innermost fingers 60 *c*, 60 *d* and the intermediate fingers 60 *b*, 60 *e* are provided with a mounting projections 83 that extend outwardly (for example out of the page as viewed in FIG. 8) from their respective fingers 60. The mounting projections 83 of the illustrated embodiment are inserted into the appropriate front mounting location 70, first rear mounting location 72, or second rear mounting location 80 and help secure the internal ventilation system 56 to the inner layer 18 of the helmet 10.

Figure 9:
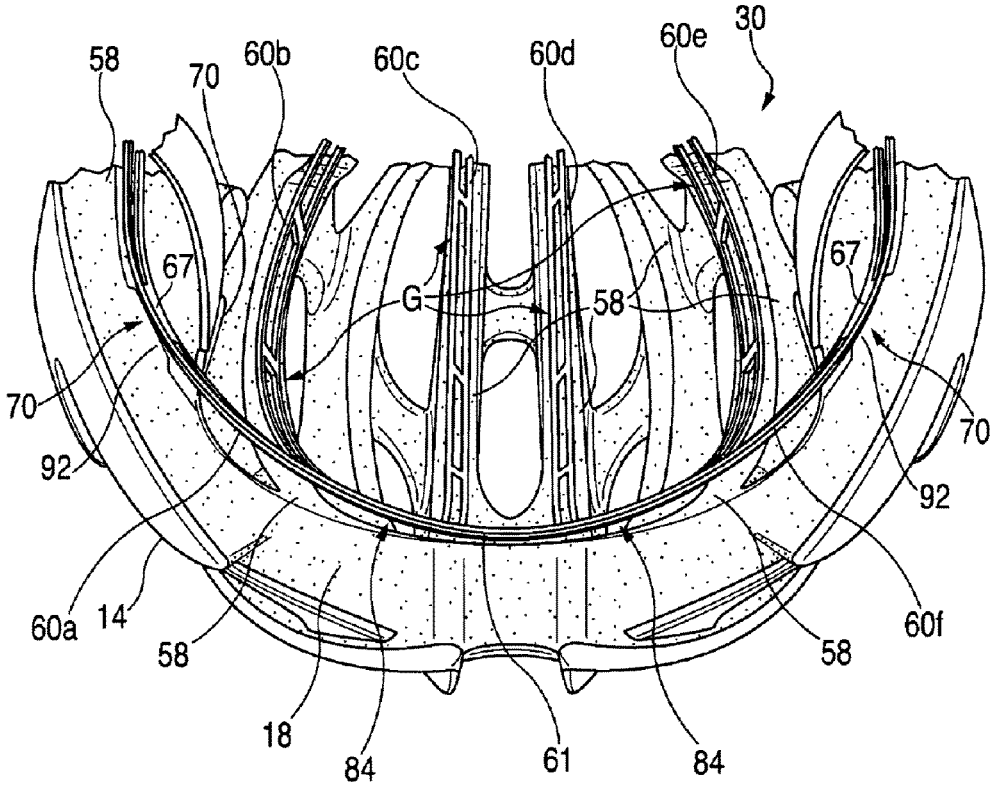
FIG. 9 is an enlarged bottom view showing a frontal portion of the helmet of FIG. 1.
Figure 10:
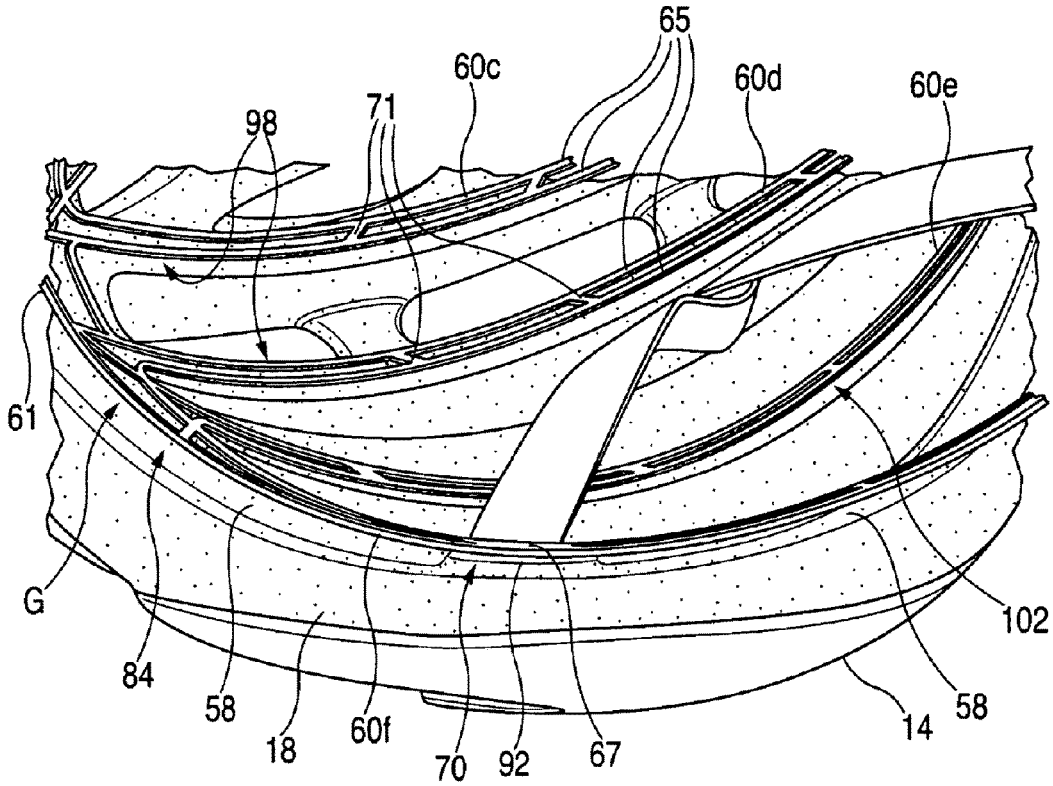
FIG. 10 is an enlarged bottom left perspective view of the helmet of FIG. 1*b* showing a forward attachment location for the internal ventilation system.

Referring also to FIGS. 9 and 10, the front portion 61 of the internal ventilation system 56 is spaced from the frontal portion 30 of the helmet 10 by a forehead gap 84. The forehead gap 84 forms part of the overall gap G (namely the leading portion of the gap G) discussed above that offsets the inner surface 58 of the helmet 10 from the wearer's head 6. The forehead gap 84 is provided by the pair of front attachment locations 70, to which the pad portions 67 of the outer fingers 60 *a*, 60 *f* are attached, for example by way of the mounting projections 83. In some embodiments, including the illustrated embodiment, the front attachment locations 70 are integrally formed with the inner layer 18, and are defined by raised projections 92 that extend generally inwardly from the inner surface 58 of the helmet 10. In this manner, the front attachment locations 70 are further inward than the adjacent portions of the inner layer 18. Other embodiments may include front attachment locations 70 in the form of standoffs, posts, spacers, and the like that are joined to the inner layer 18. In the illustrated embodiment, the pad portions 67 of the outer fingers 60 *a*, 60 *f* are secured to the front attachment locations 70 by adhesive. However, in other embodiments the pad portions 67 or some other portions of the outer fingers 60 *a*, 60 *f* can be secured to front attachment locations 70 by clips, clamps, snaps, hook and loop, and other types of fasteners.

Figure 6:
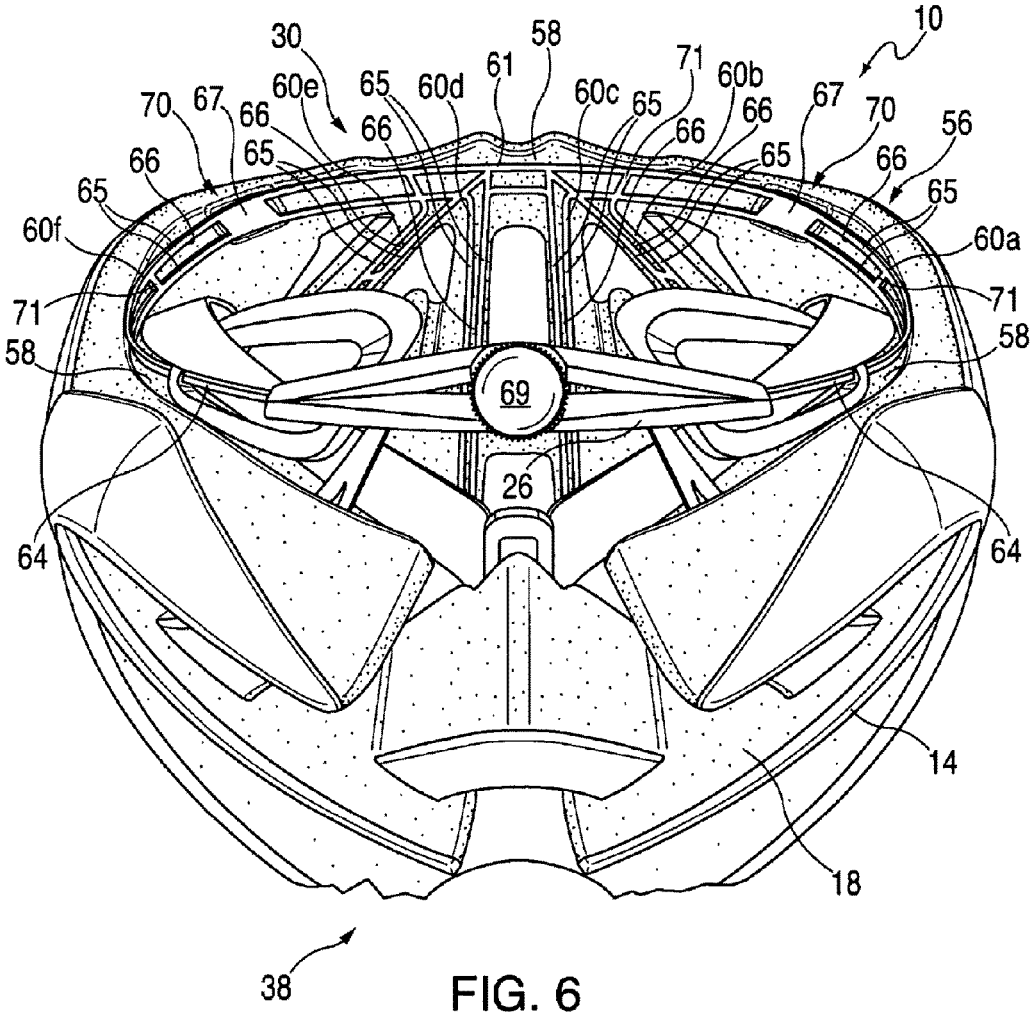
FIG. 6 is an enlarged rear perspective view of the helmet of FIG. 1*b*.
Figure 7:
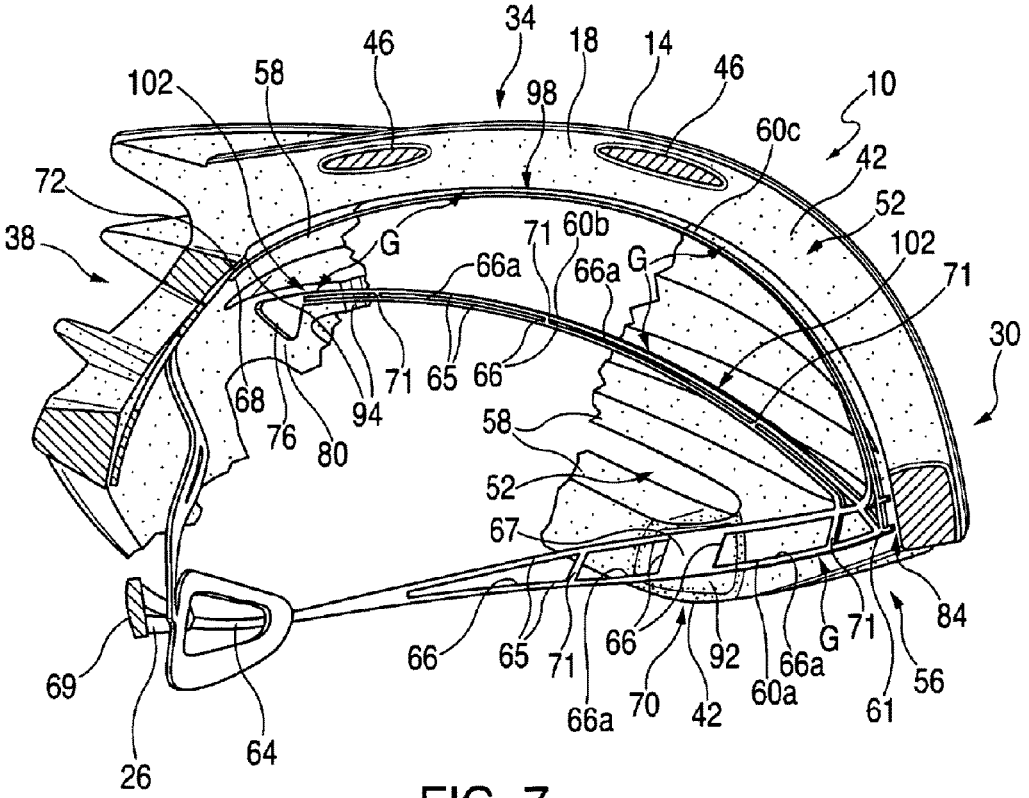
FIG. 7 is a section view taken through line 7-7 of FIG. 2, and with portions of the helmet removed for drawing clarity.

As best shown in FIGS. 6-9, in the illustrated embodiment, the front attachment locations 70 are located approximately one-quarter to one-third of the helmet periphery from the frontal portion 30 of the helmet 10, with one front attachment location 70 located on each side of the helmet 10. The location and configuration of the front attachment locations 70, along with the configuration of the outer fingers 60 *a*, 60 *f*, are such that the forehead gap 84 between the front portion 61 of the internal ventilation system 56 and the inner surface 58 of the helmet 10 remains substantially constant over the curved section that extends between the front attachment locations 70. Moreover, the forehead gap 84 remains substantially unchanged when the helmet 10 is worn by the wearer 2. As best shown in FIG. 6, the sides and distal ends 64 of the outer fingers 60 *a*, 60 *f* are similarly spaced away from the inner surface 58 of the helmet 10 to maintain the gap G between the inner surface 58 of the helmet 10 and the wearer's head 6. As such, during forward movement the forehead gap 84 allows air contacting the wearer's forehead to flow upwardly and over the wearer's head 6.

Figure 11:
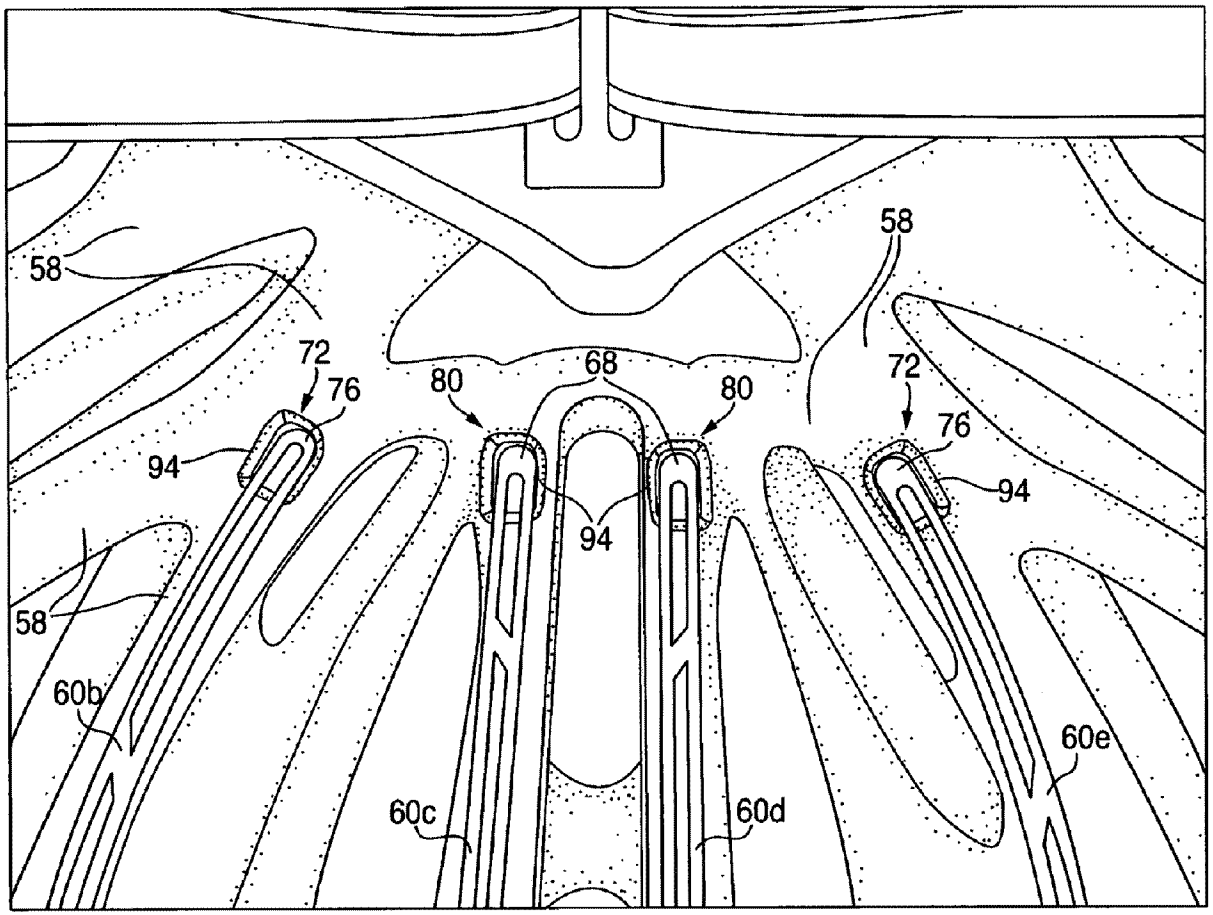
FIG. 11 is an enlarged bottom view of the helmet of FIG. 1*b* showing rear attachment locations for the internal ventilation system.

Referring also to FIG. 11, the intermediate fingers 60 *b*, 60 *e* and the innermost fingers 60 *c*, 60 *d* each extend rearwardly from the front portion 61 of the internal ventilation system 56 to respective first rear attachment locations 72 and second rear attachment locations 80. In some embodiments, including the illustrated embodiment, the first and second rear attachment locations 72, 80 are integrally formed with the inner layer 18, and are defined by raised projections 94 that extend generally inwardly from the inner surface 58 of the helmet 10. In this manner, the first and second rear attachment locations 72, 80 are further inward than the adjacent portions of the inner layer 18. Other embodiments may include first and/or second rear attachment locations 72, 80 in the form of standoffs, posts, spacers, and the like that are joined to the inner layer 18. Moreover, in the illustrated embodiment, the distal ends 68, 76 of the respective innermost fingers 60 *c*, 60 *d* and outer fingers 60 *b*, 60 *e* are secured to the first and second rear attachment locations 72, 80 by adhesive. However, in other embodiments the distal ends 68, 76 or some other portions of the innermost fingers 60 *c*, 60 *d* and/or the outer fingers 60 *b*, 60 *e* can be secured to rear attachment locations 72, 80 by clips, clamps, snaps, hook and loop, and other types of fasteners.

Figure 12:
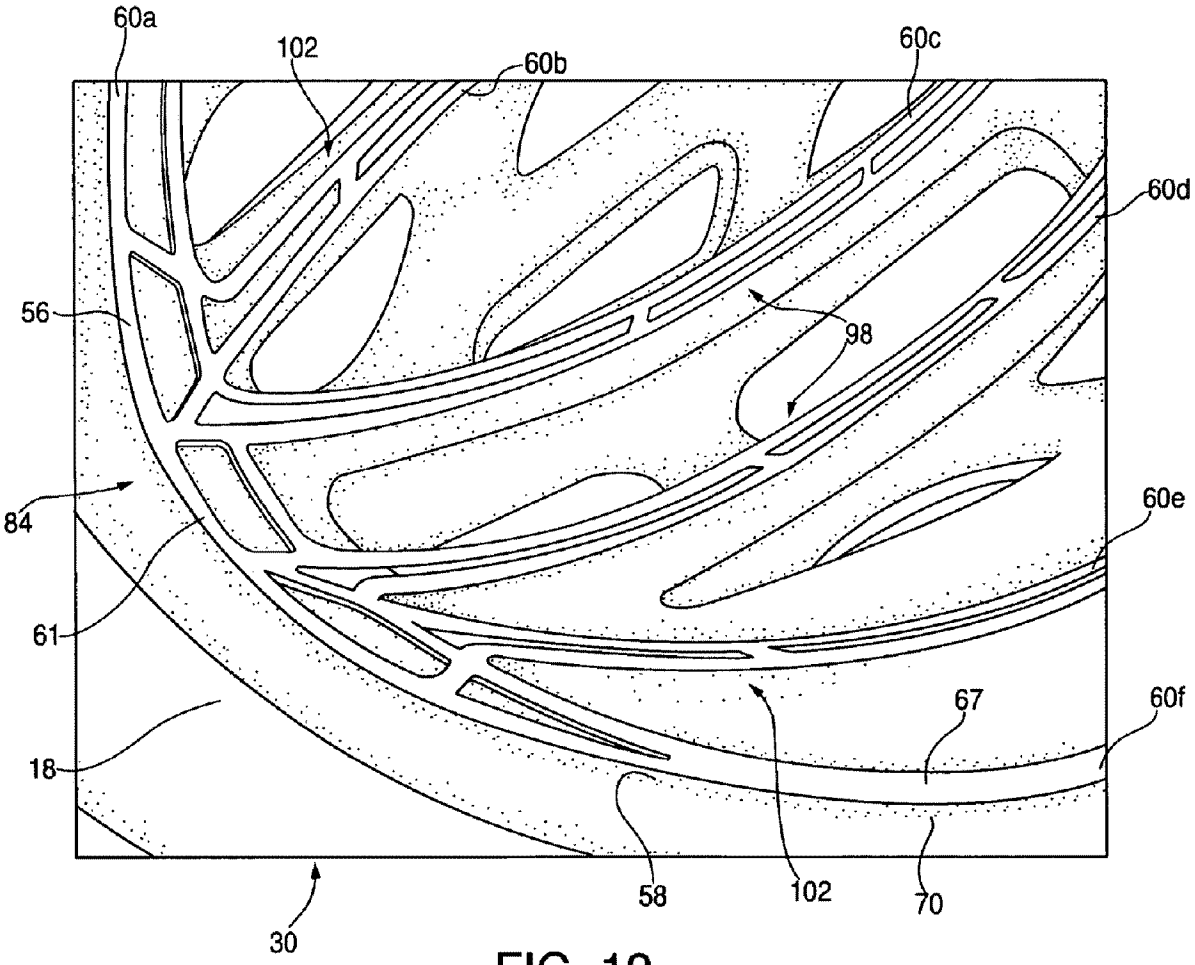
FIG. 12 is an enlarged bottom left perspective view of the helmet of FIG. 1*b* showing the frontal portion of the helmet and a front portion of the internal ventilation system.
Figure 13:
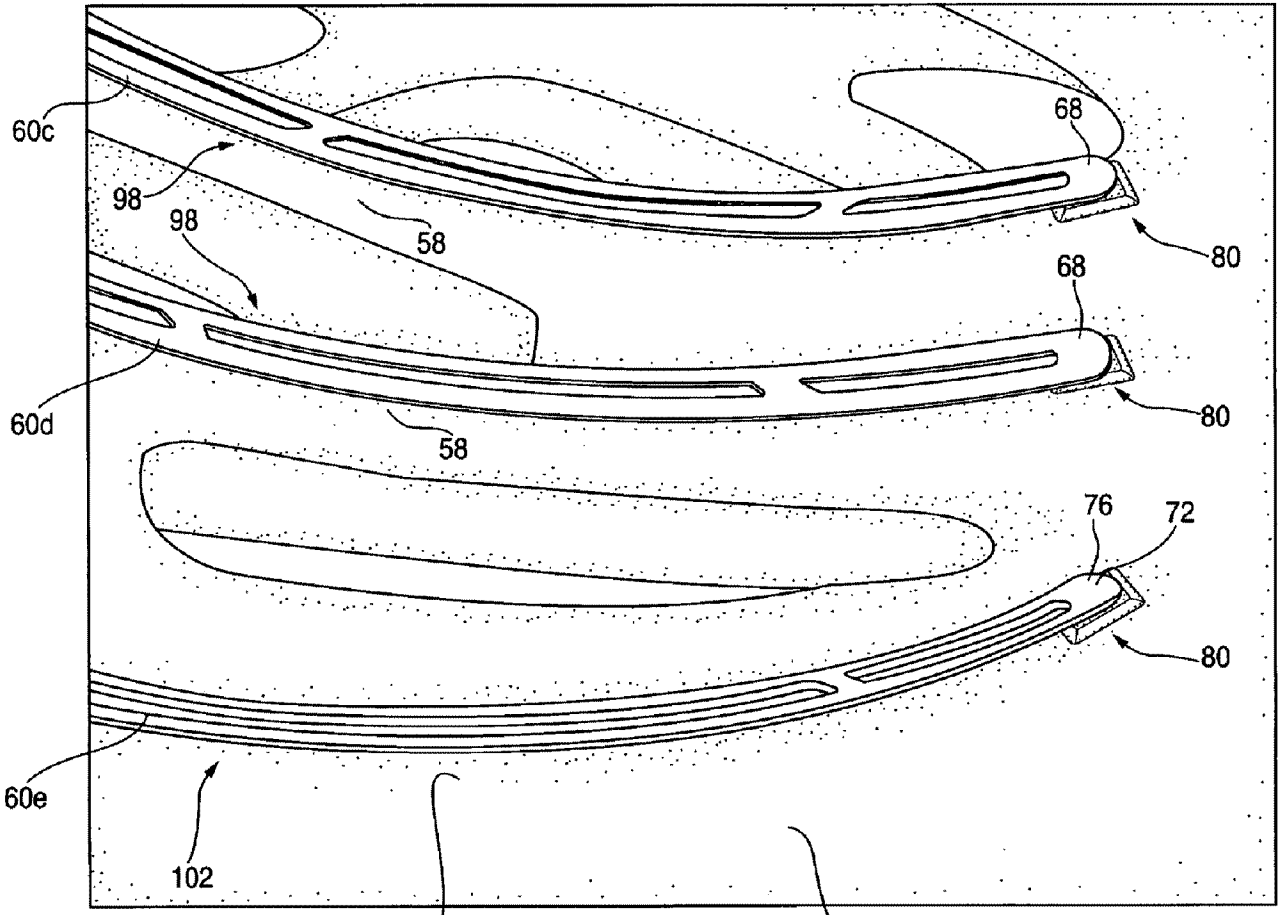
FIG. 13 is an enlarged bottom left perspective view of the helmet of FIG. 1*b* showing the rear attachment locations for the internal ventilation system.
Figure 14:
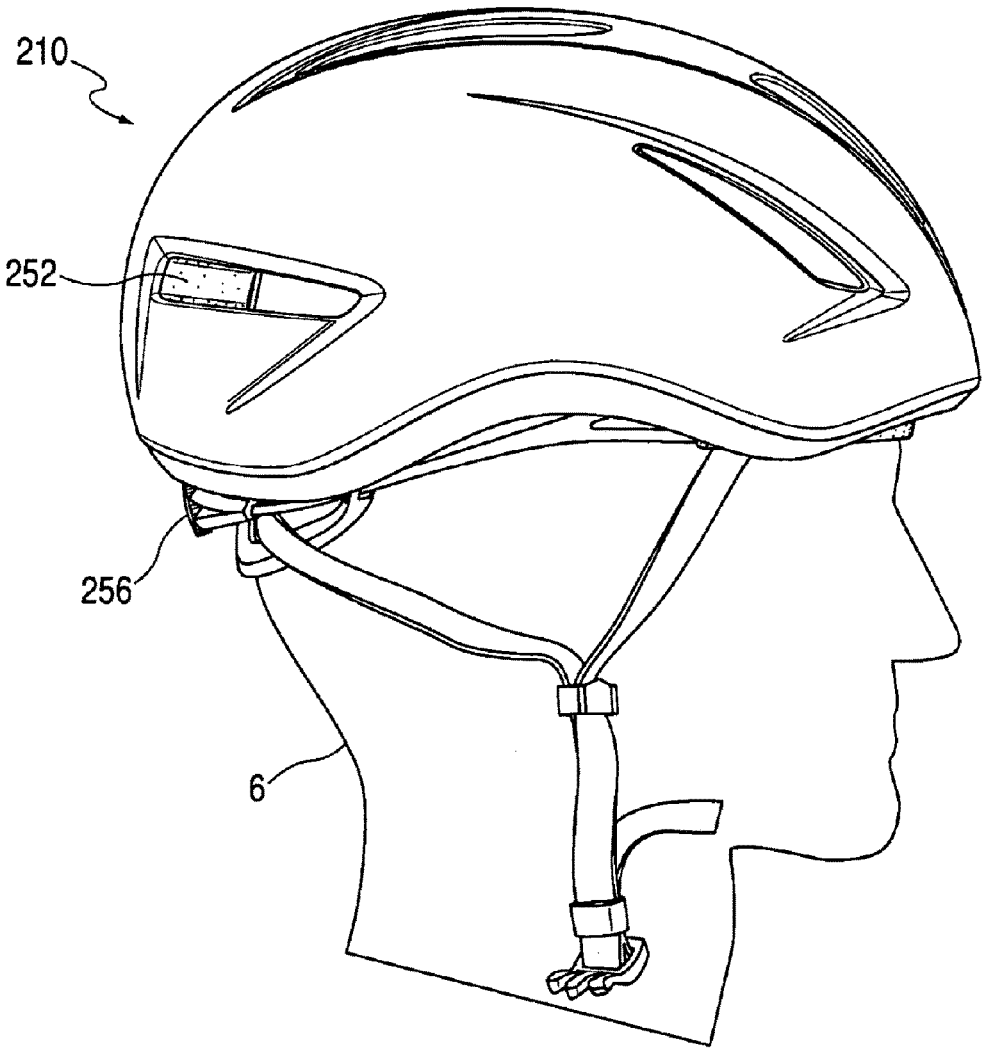
FIG. 14 is a side view of an alternative embodiment of an inventive bicycle helmet with an internal ventilation system.

As shown throughout the Figures, including also FIGS. 12 and 13, the internal ventilation system 56 is supported or otherwise spaced away from the inner surface 58 of the helmet 10 by the combination of the front attachment locations 70 and the first and second rear attachment locations 72, 80. When the helmet 10 is worn, the fingers 60 of the internal ventilation system 56 intimately contact the wearer's head 6, while the inner helmet surface 58 of the helmet is spaced away from the wearer's head 6 to form the gap G. In this manner the inner surface 58 is offset from the wearer's head 6 to provide the gap G. The gap G includes the forehead gap 84 discussed above, which extends generally along the wearer's forehead between the two front attachment locations 70. The gap G also includes innermost finger gaps 98 defined between the inner surface 58 and the innermost fingers 60 *c*, 60 *d*, and which extend generally from the forehead gap 84 rearwardly to the first rear attachment locations 72. The gap G also includes intermediate finger gaps 102 defined between the inner surface 58 and the intermediate fingers 60 *b*, 60 *e*, and which extend generally from the forehead gap 84 rearwardly to the second rear attachment locations 80.

Figure 15:
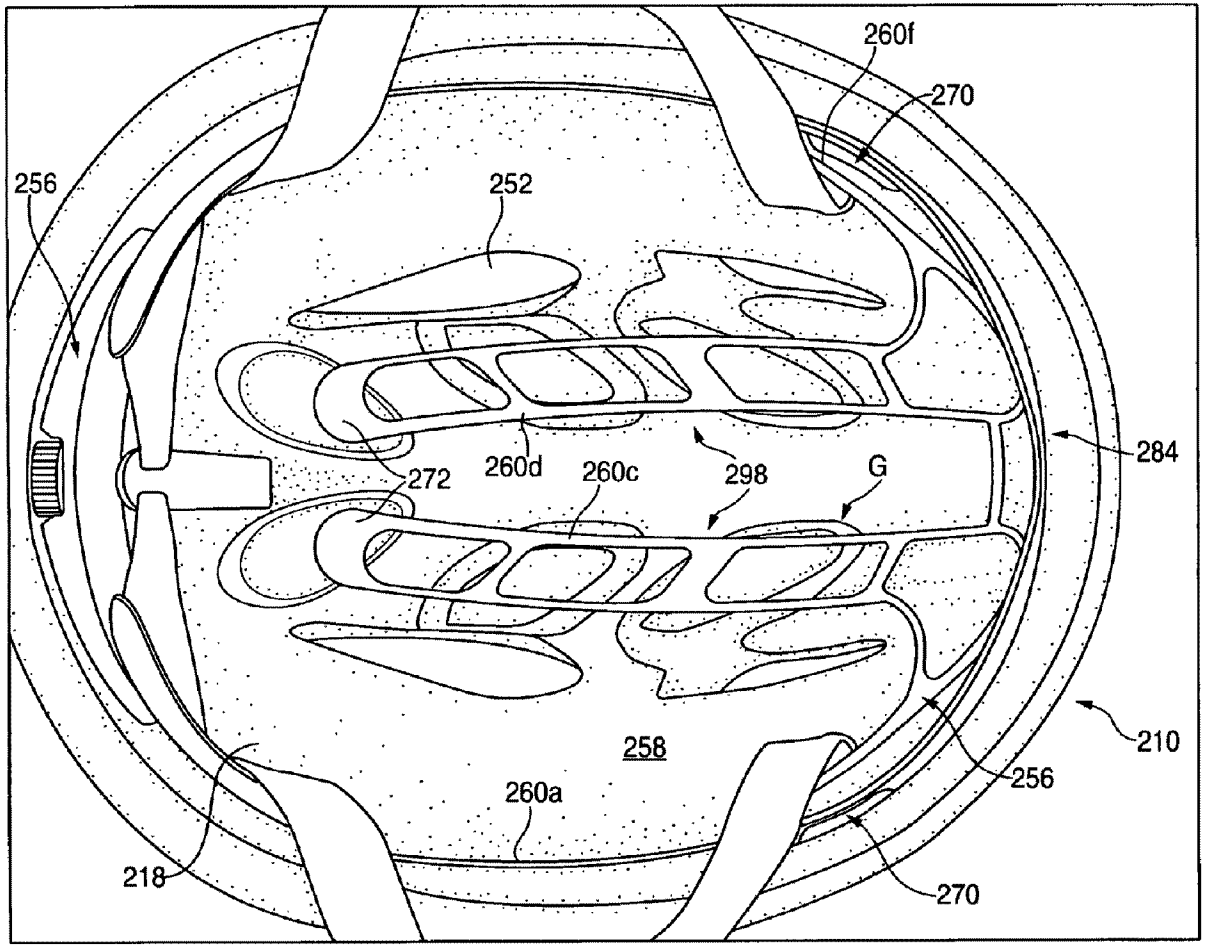
FIG. 15 is a bottom view of the helmet of FIG. 14 showing an alternative embodiment of an internal ventilation system.
Figure 16:
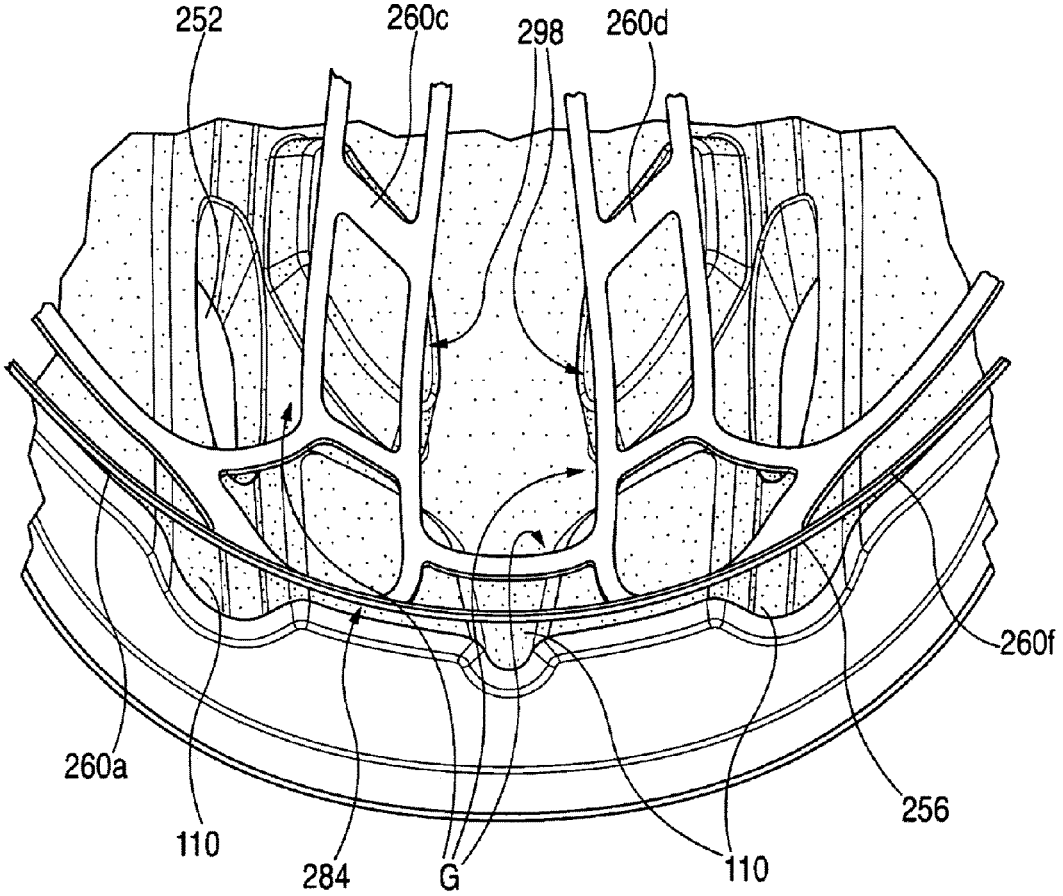
FIG. 16 is an enlarged bottom view of a frontal portion of the helmet of FIG. 14.
Figure 17:
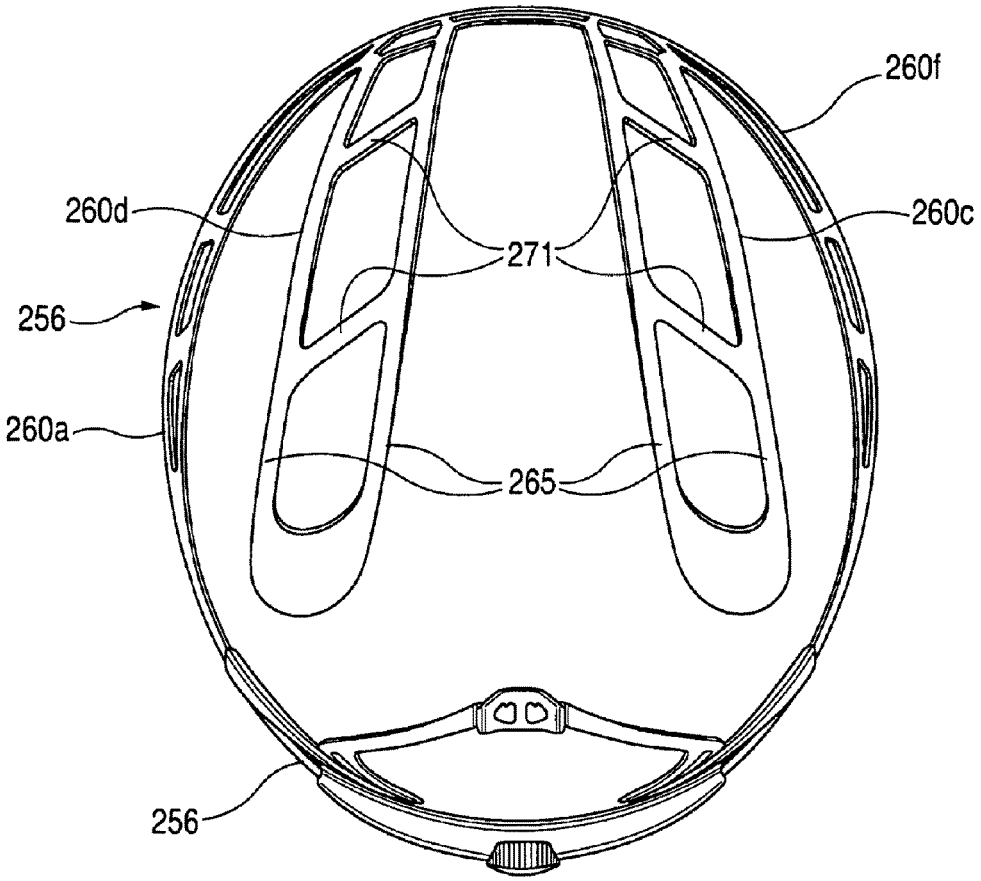
FIG. 17 is a top view of the alternative internal ventilation system removed from the helmet of FIG. 14.

FIGS. 14-17 illustrate an alternative embodiment of the invention where features of the alternative embodiment corresponding to features of the embodiment shown in FIGS. 1-13 have been given like reference numbers increased by 200. The helmet 210 of FIGS. 14-17 is what is known in the art as a sprinter helmet. As shown, the helmet 210 has far fewer ventilation openings 252 than the road helmet of FIGS. 1-13. As shown in FIGS. 15-17, the internal ventilation system 256 includes outer fingers 260 *a*, 260 *f*, that extend into an adjustment mechanism 226, and a pair of inner fingers 260 *c*, 260 *d*. In the alternative embodiment, the intermediate fingers have been eliminated, and the inner fingers 260 *c*, 260 *d*, which include rails 265 and ribs 271 (FIG. 17), have been widened.

The internal ventilation system 256 is attached to the inner layer 218 at front mounting locations 270, and rear mounting locations 272 (FIG. 15). The front and rear mounting locations 270 and 272 are offset from the inner surface 258 of the inner layer 218 such that, when the helmet 210 is worn, the internal ventilation system 256 provides a gap G between the wearer's head 6 and the inner surface 258. As best shown in FIG. 16, the gap G also includes a forehead gap 284 such that air contacting the wearer's forehead can flow upwardly between the wearer's forehead and the inner surface 258 of the inner layer 218. The gap G also includes inner finger gaps 298 between the inner fingers 260 *c*, 260

*d* and the inner surface 258. In the alternative embodiment of FIGS. 14-17, the inner layer 218 is provided with recessed channels 110 that communicate with the forehead gap 284 to provide additional air flow into the gap G between the surface of the wearer's head and the inner surface 258.

By spacing the inner surface 58, 258 of the helmet 10, 210 away from the wearer's head 6 and creating the gap G, ventilating air flows between the wearer's head 6 and the helmet 10, 210 (see FIG. 4), thereby improving ventilation and reducing heat build-up within the helmet 10, 210, which in turn helps to cool the wearer's head 6. When moving in a forward direction relative to the ground, such as when the cyclist 2 pedals the bicycle 4, air proximate the wearer's forehead flows upwardly through the forehead gap 84, 284 and then generally rearwardly, around, and through the gap G, including along the innermost finger gaps 98, 298 and intermediate finger gaps 102. Air can then exit the helmet 10, 210 through one of the ventilation openings 52, 252 provided in the rear portion 38 of the helmet 10. Furthermore, because the first and second rear attachment locations 72, 80 (in helmet 10), and the rear attachment locations 272 are laterally spaced apart from each other, air is also permitted to flow generally downwardly between the various rear attachment locations 72, 80, 272 and can exit the helmet 10 by flowing generally downwardly and over the back of the wearer's neck. Such downwardly-directed flow that passes over the back of the wearer's neck may be particularly prominent in embodiments like the embodiment of FIGS. 14-17 or in the aero helmet discussed above, which have few or no ventilation openings 52, 252 through which the air might otherwise exit the helmet 210. Thus, with the exception of the extremely small surface area of the wearer's head 6 that is in intimate contact with the fingers 60, 260, substantially the entire surface of the wearer's head 6 is exposed to ventilating air flow through the gap G. The structure of the internal ventilation systems 56, 256 discussed above maintain the gap G between the inner helmet surface 58, 258 and the wearer's head 6 while the respective helmet 10, 210 is worn during the cycling activity.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A helmet for protecting the head of a wearer, the helmet comprising:

an outer shell;

an energy dissipating inner layer coupled to the outer shell, the inner layer defining an inner surface;

a front attachment location inwardly offset from the inner surface substantially at a front portion of the helmet;

a rear attachment location inwardly offset from the inner surface substantially at a rear portion of the helmet; and an internal ventilation system comprising a flexible web coupled to the helmet and is supported by the front attachment location and the rear attachment location, extends at least from the front portion to the rear portion, and is offset from the inner surface for at least a portion of the flexible web between the front attachment location and the rear attachment location, wherein the flexible web, the front attachment location, and the rear attachment location cooperate to define a continuous ventilation gap between the flexible web and the inner surface from the front portion of the helmet to the rear portion of the helmet.

2. The helmet of claim 1, wherein the flexible web comprises fingers extending from the front attachment location to the rear attachment location.

3. The helmet of claim 2, wherein the flexible web comprises a plurality of ventilation apertures therethrough.

4. The helmet of claim 1, wherein the flexible web extends along side portions of the helmet.

5. The helmet of claim 4, wherein the flexible web that extends along side portions of the helmet and comprises a pair of outer fingers that extend along the side portions of the helmet.

6. The helmet of claim 1, wherein the flexible web extends across a crown portion of the inner surface of the helmet.

7. The helmet of claim 6, wherein the flexible web extends from the crown portion of the inner surface of the helmet to each of at least two side portions of the helmet.

8. The helmet of claim 1, wherein the internal ventilation system includes a finger having a portion coupled to the front attachment location and a distal end coupled to the rear attachment location, and wherein the entire finger between the front attachment location and the rear attachment location is offset from the inner surface.

9. The helmet of claim 8, wherein the finger is one of a plurality of fingers each comprising a front attachment portion coupled to the front attachment location, and each of the plurality of fingers is offset from the inner surface of the inner layer to define a ventilation gap between the inner surface and head of the wearer when the helmet is worn.

10. The helmet of claim 9, wherein the gap includes a forehead gap defined between at least one outer finger and the inner surface, and an inner gap defined between at least one inner finger and the inner surface.

11. A helmet comprising:

an outer shell;

an energy dissipating inner layer coupled to the outer shell, the inner layer defining an inner surface, at least a first attachment location inwardly offset from the inner surface at a first location of the helmet;

a second attachment location inwardly offset from the inner surface at a second location of the helmet separate from the first location; and a flexible web comprising at least one portion of the flexible web that generally follows a curvature of the inner surface, wherein the flexible web is coupled to the first attachment location and the second attachment location, the at least one portion extending between the first attachment location and the second attachment location and spaced away from the inner surface to define a ventilation gap that extends from the front portion of the helmet to the rear portion of the helmet between the first attachment location and the second attachment location.

12. The helmet of claim 11, wherein the first attachment location is at a front portion of the helmet and the second attachment location is at a rear portion of the helmet.

13. The helmet of claim 12, wherein the flexible web comprises fingers extending from the first attachment location to the second attachment location.

14. The helmet of claim 12, wherein the at least a first attachment location comprises at least two attachment locations positioned on left and right sides of the front portion of the helmet.

15. The helmet of claim 11, wherein the flexible web comprises a plurality of ventilation apertures therethrough.

16. The helmet of claim 11, wherein the flexible web extends along side portions of the helmet.

17. The helmet of claim 16, wherein the flexible web that extends along side portions of the helmet and comprises a pair of outer fingers that extend along the side portions of the helmet.

18. The helmet of claim 11, wherein the flexible web extends across a crown portion of the inner surface of the helmet.

19. The helmet of claim 11, wherein the ventilation gap further comprises a forehead gap between the flexible web and the inner surface at a front portion of the helmet.

20. A helmet comprising:

an outer shell;

an energy dissipating inner layer coupled to the outer shell, the inner layer defining an inner surface, a first attachment location inwardly offset from the inner surface at a front portion of the helmet;

a second attachment location inwardly offset from the inner surface at a rear portion of the helmet; and a flexible web comprising at least one portion of the flexible web that generally follows a curvature of the inner surface, wherein the flexible web is coupled to the first attachment location and the second attachment location, the at least one portion extending between the first attachment location and the second attachment location and spaced away from the inner surface to define a ventilation gap that extends between the first attachment location and the second attachment location;

wherein the flexible web comprises fingers extending from the first attachment location to the second attachment location and wherein the fingers comprise ventilation apertures extending therethrough.

* * * * *